US008186168B2

(12) United States Patent
Heathco

(10) Patent No.: US 8,186,168 B2
(45) Date of Patent: May 29, 2012

(54) THRUST BALANCE OF ROTOR USING FUEL

(75) Inventor: Craig Heathco, Martinsville, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 888 days.

(21) Appl. No.: 12/175,705

(22) Filed: Jul. 18, 2008

(65) Prior Publication Data

US 2010/0014957 A1 Jan. 21, 2010

(51) Int. Cl.
*F02C 1/00* (2006.01)
*F02G 3/00* (2006.01)

(52) U.S. Cl. ..... 60/772; 60/734; 60/39.091

(58) Field of Classification Search ..... 60/39.08, 60/39.091, 734, 772, 779; 415/1, 96, 104, 415/106

See application file for complete search history.

(56) References Cited

U.S. PATENT DOCUMENTS

| | | | | |
|---|---|---|---|---|
| 2,966,296 | A | 12/1960 | Morley et al. | |
| 4,306,834 | A | 12/1981 | Lee | |
| 4,714,405 | A * | 12/1987 | Schaefer et al. | 415/168.2 |
| 6,305,901 | B1 | 10/2001 | Bell et al. | |
| 6,655,906 | B1 | 12/2003 | Yuri et al. | |
| 7,096,658 | B2 * | 8/2006 | Wernberg et al. | 60/39.281 |

* cited by examiner

*Primary Examiner* — Ehud Gartenberg
*Assistant Examiner* — Arun Goyal
(74) *Attorney, Agent, or Firm* — Krieg Devault LLP

(57) ABSTRACT

A method of at least partially balancing axial thrust loads and an engine in which the method is carried out is disclosed herein. The engine includes a combustion chamber and a fuel system operable to direct pressurized fuel to the combustion chamber. The engine also includes a rotor operable to rotate about a centerline axis and subjected to axial thrust loads during operation. The engine also includes a balance piston engaged with the rotor. The balance piston includes a pressure face positioned in a thrust cavity. The engine also includes a fluid passageway extending between the fuel system and the thrust cavity. Pressurized fuel is delivered to the pressure face to counteract axial thrust loads on the rotor.

23 Claims, 6 Drawing Sheets

THRUST BALANCE OF ROTOR USING FUEL

STATEMENT REGARDING FEDERALLY SPONSORED RESEARCH OR DEVELOPMENT

The present invention was made under U.S. Government Contract Number N00014-04-D-0068 awarded by the Department of Defense, and the Department of Defense may have certain rights in the present invention.

BACKGROUND OF THE INVENTION

1. Field of the Invention

The invention relates to a method and to structure for at least partially balancing axial thrust loads experienced by a rotor of an engine.

2. Description of Related Prior Art

Most engines include rotors or shafts that rotate about a centerline axis. In a turbine engine, one or more rotors can support compressor blades and turbine blades. The compressor blades can be components of a compressor section for compressing fluid such as air. The turbine blades can be components of a turbine section downstream of the compressor section for converting the energy associated with combustion gases into kinetic energy. The rotor or rotors supporting the compressor blades and the turbine blades rotate about a centerline axis. The compression of fluid in the compressor section can generate axial thrust loads on the rotor or rotors along the centerline axis. Similarly, the conversion of energy associated with the combustion gases in the turbine section can generate axial thrust loads on the rotor or rotors along the centerline axis. Several factors can affect the extent of axial thrust loads; examples of these factors include, and are not limited to, the compression ratio of fluid, the firing temperature of combustion gases, and the thrust generated by the turbine engine.

Axial thrust loads can be addressed with thrust bearings supporting the one or more rotors of the turbine engine. Turbine engine designs that incur relatively high axial thrust loads incorporate relatively large thrust bearings. A balance piston is another structure applied in turbine engines to counteract axial thrust loads. In a balance piston arrangement, compressed air from a compressor of the turbine engine is applied against a pressure face of some structure acting as the piston. The piston is engaged with the one or more rotors of the turbine engine. The fluid pressure acts on the effective area of the pressure face to counteract the engine thrust. The term "balance" is used in the art, but the force generated on the rotor through a balance piston may not actually balance the forces on acting on the rotor.

SUMMARY OF THE INVENTION

In summary, the invention is a method of at least partially balancing axial thrust loads and an engine in which the method is carried out. The engine includes a combustion chamber and a fuel system operable to direct pressurized fuel to the combustion chamber. The engine also includes a rotor operable to rotate about a centerline axis and subjected to axial thrust loads during operation. The engine also includes a balance piston engaged with the rotor. The balance piston includes a pressure face positioned in a thrust cavity. The engine also includes a fluid passageway extending between the fuel system and the thrust cavity. Pressurized fuel is delivered to the pressure face to counteract axial thrust loads on the rotor.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF EXEMPLARY EMBODIMENTS

Figure 1:
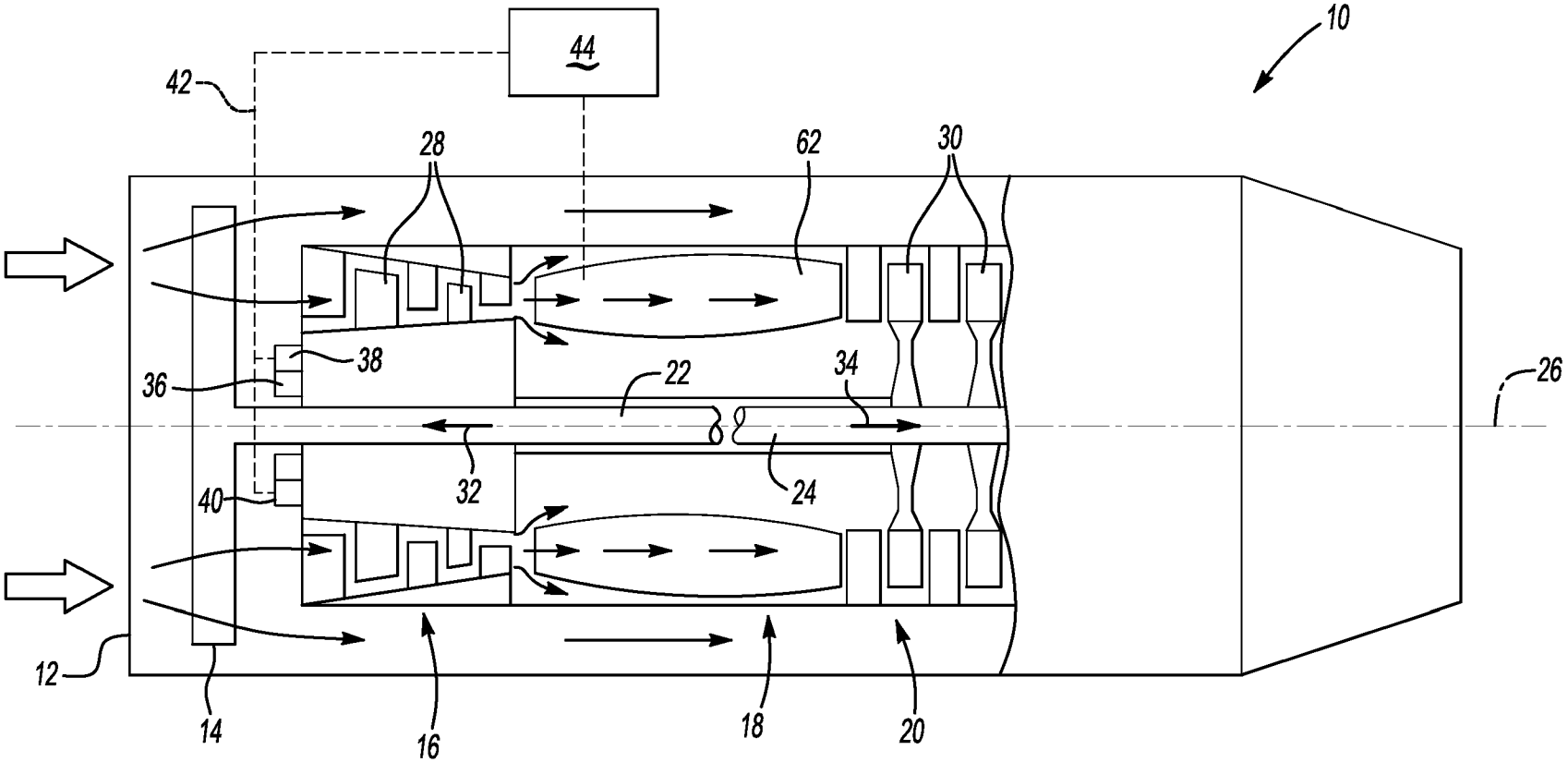
FIG. 1 is a schematic representation of the present invention.

A plurality of different embodiments of the invention is shown in the Figures of the application. Similar features are shown in the various embodiments of the invention. Similar features have been numbered with a common reference numeral and have been differentiated by an alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

In turbine engines, one or more rotors of the engine can be subjected to axial thrust loads during operation. These axial thrust loads can be maximized during the periods of highest power output for the engine. In a turbine engine providing jet propulsion for an aircraft (manned or unmanned), this period of maximized power output can occur when the aircraft is taking-off and/or climbing to a cruising altitude. A thrust bearing can be positioned to support the rotor against these axial thrust loads and will be designed to withstand the highest axial thrust loads that occur during operation. In some applications, the turbine engine can be operated for only short periods of high power output and relatively longer periods of low power output. In such an application, a relatively robust thrust bearing will be required despite being needed for only a small percentage of the engine's operating time. It is noted that the invention is not limited to turbine engines applied to aircraft propulsion.

The present invention provides a method and apparatus for permitting a smaller and less costly thrust bearing to be incorporated with turbine engines having rotors subjected to axial thrust loads, as shown by several alternative embodiments set forth below. The invention can be especially beneficial to turbine engines operated for short periods of high power output and longer periods of low power output. However, the invention is not limited to turbine engines and is not limited to turbine engines operating in any particular manner. The invention can be beneficial to engines operating at a generally constant rate of power output by allowing thrust bearings to be smaller and less costly.

In the invention, a balance piston is engaged with a rotor of the engine and pressurized fuel from the engine acts upon the balance piston. The pressure of the fuel can correspond to the output of the engine and therefore the force acting through the balance piston can correspond to the severity of axial thrust loads. For example, when engine output is relatively low the fuel pressure is generally relatively low, axial thrust loads can also be relatively low, and therefore the pressure acting on the balance piston can be relatively low. Conversely, when engine output is relatively high the fuel pressure can be relatively high, axial thrust loads can be relatively high, and the pressure acting on the balance piston can be relatively high.

The invention can be totally or at least partially passive. A fuel system for delivering fuel to an engine will be functioning during engine operation to deliver fuel; therefore, an embodiment of the invention can simply bleed fuel from the fuel system without requiring active components such as sensors, controllers, actuators, and electromechanical valves. However, the invention can also be practiced with supplemental structures or powered components as an active system. In some situations, the value of a fully or partially active system may outweigh the drawbacks. Alternative embodiments of the invention can be partially or fully active.

FIG. 1 schematically shows a turbine engine 10. The exemplary turbine engine 10 can include an inlet 12 with a fan 14 to receive fluid such as air. Alternative embodiments of the invention may not include a fan. The turbine engine 10 can also include a compressor section 16 to receive the fluid from the inlet 12 and compress the fluid. The turbine engine 10 can also include a combustor section 18 to receive the compressed fluid from the compressor section 16. The compressed fluid can be mixed with fuel and ignited in a combustion chamber 62 defined by the combustor section 18. The turbine engine 10 can also include a turbine section 20 to receive the combustion gases from the combustor section 18. The energy associated with the combustion gases can be converted into kinetic energy (motion) in the turbine section 20.

In FIG. 1, rotors 22, 24 are shown disposed for rotation about a centerline axis 26 of the turbine engine 10. Alternative embodiments of the invention can include any number of rotors. The rotors 22, 24 can be journaled together for relative rotation or splined for fixed rotation together. The rotor 22 can support compressor blades 28 of the compressor section 16. The rotor 24 can support turbine blades 30 of the turbine section 20.

In operation, the rotor 22 can be subjected to axial thrust loads in response to the compression of fluid in the compressor section 16. An arrow 32 represents the direction of axial thrust loads on the rotor 24. Similarly, the rotor 24 can be subjected to axial thrust loads in response to the creation of kinetic energy in the turbine section 20. An arrow 34 represents the direction of axial thrust loads on the rotor 22. It is noted that during the operation of the turbine engine 10, the axial thrust load can change in value and may change direction. The invention can be practiced with a first balance piston at the forward end of the turbine engine and operable to counter-act thrust loads in the direction of the arrow 32 and a second balance piston at the aft end of the turbine engine and operable to counter-act thrust loads in a direction opposite to the direction of the arrow 32.

A thrust bearing 36 can be positioned to support the rotor 22 against the axial thrust loads represented by arrow 34. A similar thrust bearing (not shown) can be positioned to support the rotor 24 against the axial thrust loads represented by arrow 34. A balance piston 38 can also be positioned to support the rotor 22 against the axial thrust loads represented by arrow 32. The balance piston 38 can include a pressure face 40 facing away from the direction of axial thrust loads. A similar balance piston (not shown) can be positioned to support the rotor 24 against the axial thrust loads represented by arrow 34. The description set forth below with respect to the balance piston 38 can also be applied to a balance piston supporting the rotor 24.

A fluid passageway or line 42 can communicate pressurized fuel to the pressure face 40 from a fuel system 44. The fuel system 44 can also deliver pressurized fuel to the combustion chamber 62 of the combustor section 18. A force equal to the pressure of the fuel multiplied by the area of the pressure face 40 can be generated on the balance piston 38, the force acting in a direction opposite to the direction of the arrow 32. The generated force can at least partially reduce the axial load acting on the thrust bearing 36 through the rotor 22.

The pressurized fuel directed to the combustion chamber 62 and the pressurized fuel delivered to the pressure face 40 can be moved by a common fuel pump, or dedicated pumps can be applied to move respective streams of pressurized fuel. Thus, the fuel system 44 can include one or more pumps. If a single fuel pump is applied, pressurized fuel can be diverted from passage to the combustion chamber 62.

Figure 2:
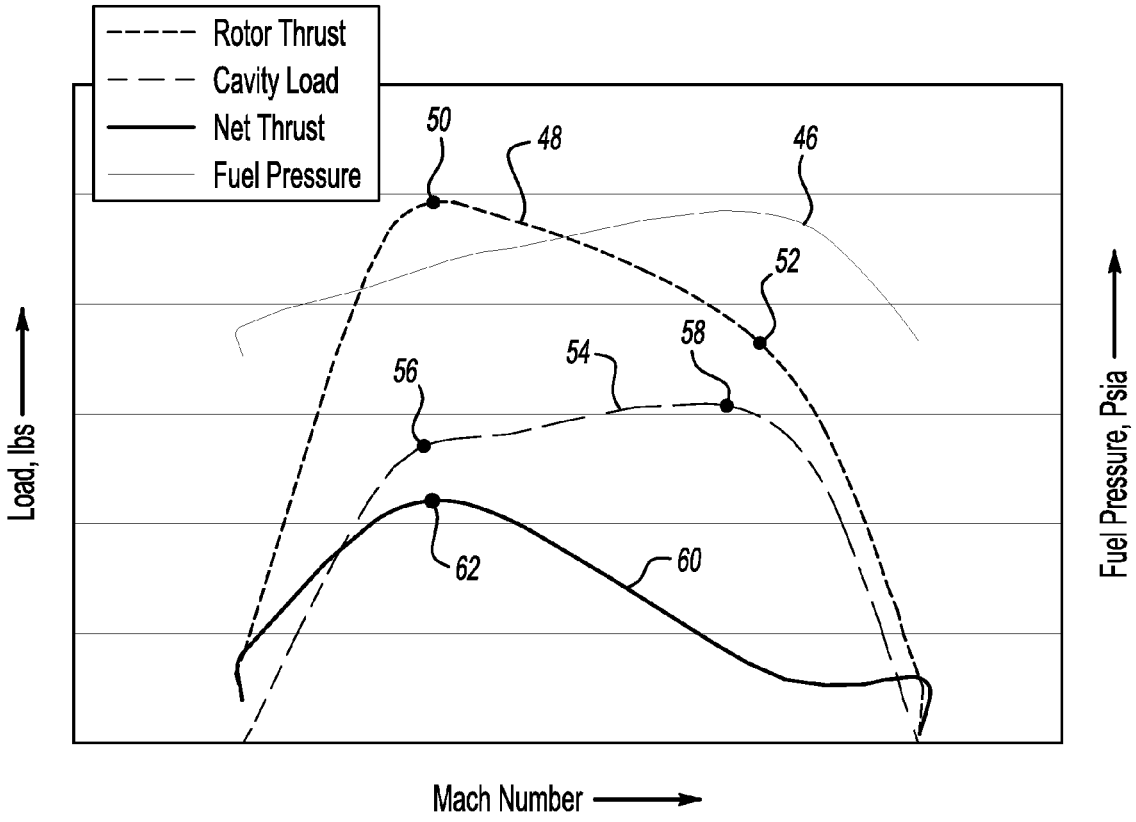
FIG. 2 is a graph showing a relationship between axial thrust loads, fuel pressure, and Mach number in an embodiment of the invention.

FIG. 2 is a graph showing a relationship between axial thrust loads, fuel pressure, and Mach number in an embodiment of the invention in which a turbine is applied to the jet propulsion of an aircraft. Again, as set forth above, the invention can be practiced in other applications of engines generally and other applications of turbine engines, including land-based turbine engines. The bottom scale of the graph is associated with Mach number of the aircraft and corresponds to the power output of the turbine engine. A line 46 represents fuel pressure. The right-hand scale of the graph is associated with the pressure in pounds per square inch (psi). The horizontal bars of the graph can represent gradients of two hundred pounds per square inch for the purposes of discussion and not limitation. In applications of turbine engines wherein fuel pressure is relatively high at maximum power output, embodiments of the invention can be advantageous since the size of the balance piston can be relatively small. The graph shows that as the Mach number increases, fuel pressure steadily increases before tapering off. The fuel pressure can be between about 700 psi and about 1000 psi in operation.

A line 48 represents rotor thrust. The left-hand scale of the graph is associated with thrust or load in pounds. The horizontal bars of the graph can represent gradients of seven hundred and fifty pounds for the purposes of discussion and not limitation. The thrust or load experienced by the rotor can, in turn, result in an axial load on a thrust bearing in the turbine engine. The graph shows that as the Mach number increases, the rotor thrust increases rapidly to maximum value at a point 50, deceases gradually until reaching a point 52, and then rapidly decreases. The axial load on the thrust bearing could be shown to be generally similar the change in rotor thrust as Mach number changes.

A line 54 represents "cavity load" or the pressure inside a thrust cavity in which a balance piston can be disposed. In other words, the cavity load corresponds to the force or load applied to the rotor through a balance piston; this load counteracts the rotor thrust represented by line 48. The line 54 can intersect the bottom scale at approximately Mach 0.5 and Mach 3.0 in the exemplary embodiment of the invention. The graph shows that as the Mach number increases, the cavity load increases rapidly to a point 56, increases further at slower rate to a point 58, and then rapidly decreases. During the operation of the turbine engine between points 56 and 58, the line 54 is generally parallel to the line 46 representing fuel pressure.

A line 60 represents the net or overall thrust acting on the rotor. The net thrust value at any particular Mach number is generally the difference between (1) the thrust value for rotor thrust represented by the line 48 at that Mach number and (2) the cavity load represented by line 54 at that Mach number. The maximum value of net thrust can occur at point 62. Generally, the cavity load represented by line 54 can reduce the rotor thrust represented by line 48 in half. It is noted that the reduction in rotor thrust may be less or greater than fifty percent in other embodiments of the invention. The dimensionless data represented in the graph of FIG. 2 could apply to any of the embodiments of the invention described herein and/or could apply to other embodiments of the invention.

The net thrust on the rotor, represented by line 60, corresponds to the axial load acting on the thrust bearing. Thus, by reducing the net thrust on the rotor, the invention can reduce the axial load on the thrust bearing. For example, if the overall or net thrust on the rotor is reduced by half, the axial load on the thrust bearing may be reduced in half.

Figure 3:
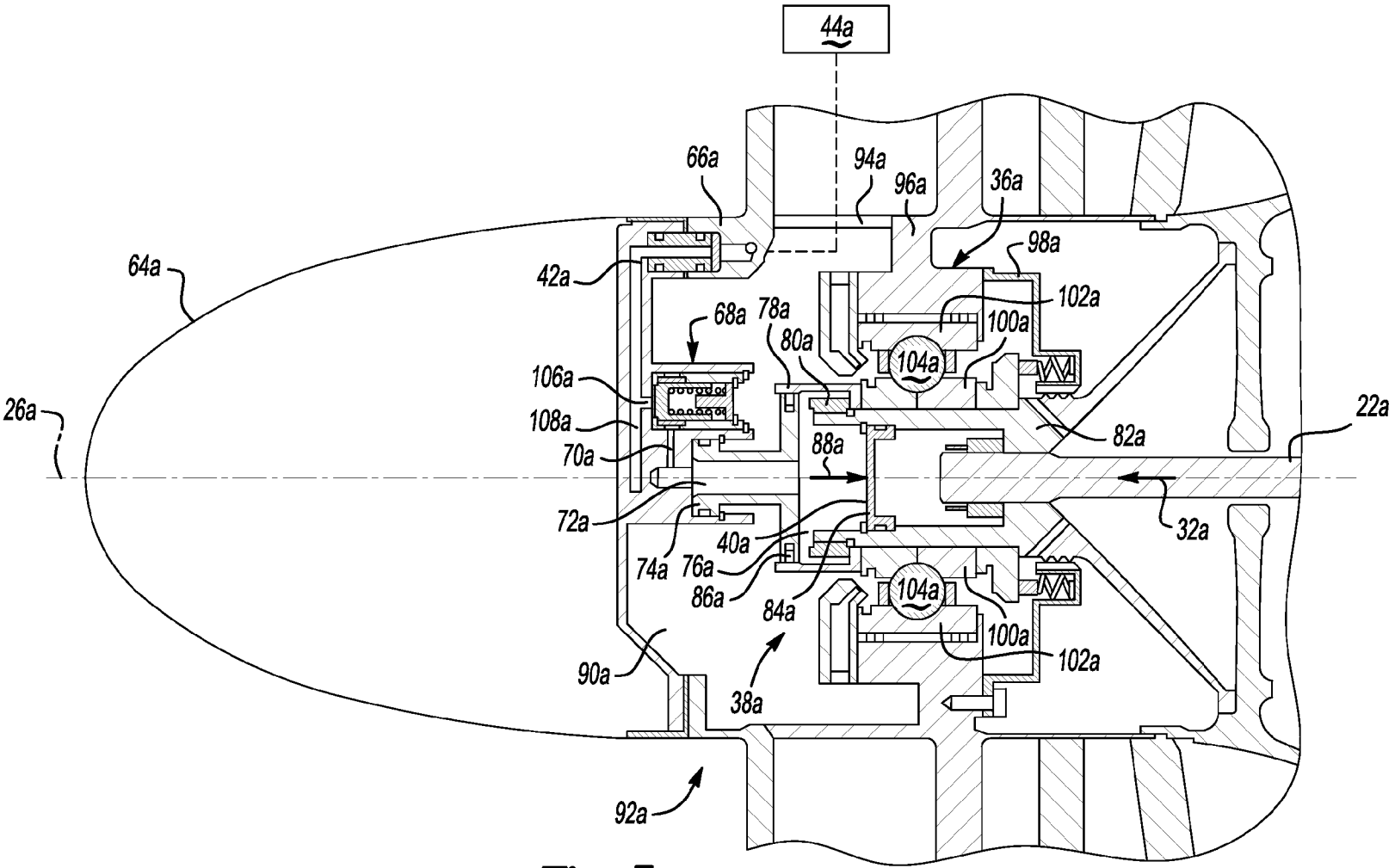
FIG. 3 is a cross-section of a first exemplary embodiment of the invention.

FIG. 3 shows a first embodiment of the invention in cross-section. A portion of a turbine engine is shown extending along a centerline axis 26*a* and having a nose cone 64*a* supported by a first frame member 66*a*. A fluid passageway 42*a* is supported on the first frame member 66*a* and extends between a fuel system 44*a* (shown schematically) and a valve 68*a*. The valve 68*a* can be a shuttle valve with an emergency bypass. Alternatively, in other embodiments of the invention, the valve 68*a* can be any passive, mechanically actuated valve such as a poppet valve or a flapper valve. Furthermore, the valve 68*a* can be an active, electromechanical valve in alternative embodiments of the invention.

Pressurized fuel can travel through the fluid passageway 42*a* to the valve 68*a*. In the second exemplary embodiment of the invention, the valve 68*a* can move to an open configuration if the fluid pressure of the fuel is at a predetermined level. In the second exemplary embodiment of the invention it can be desirable that the valve 68*a* open when fuel pressure is approximately seven hundred pounds per square inch (700 p.s.i.). When fluid pressure of the fuel drops below the predetermined level, the valve 68*a* can move to a closed configuration and stop the flow of the pressurized fluid. However, it is noted that including a valve is not necessary for practicing the broader invention and that if a valve is included in any particular embodiment of the invention, the predetermined level of fluid pressure can be different than 700 p.s.i.

After passing through the valve 68*a*, the pressurized fuel can move through a passageway 70*a* defined in the first frame member 66*a* and a passageway 72*a* defined by a cap member 74*a*. The passageway 72*a* can open into a thrust cavity 76*a*. In the second exemplary embodiment of the invention, the thrust cavity 76*a* can be defined by surfaces of the cap member 74*a*, a casing 78*a*, a spanner nut 80*a*, a barrel member 82*a*, and a plate member 84*a*.

The casing 78*a*, spanner nut 80*a*, barrel member 82*a*, and plate member 84*a* can be fixed together. The plate member 84*a* can define a pressure face 40*a*. The casing 78*a*, spanner nut 80*a*, barrel member 82*a*, and plate member 84*a* functions as the balance piston 38*a*. Alternatively, merely the plate member 84*a* functions as the balance piston 38*a* since the plate member 84*a* defines the pressure face 40*a*.

The cap member 74*a* and the combined structure of the casing 78*a*, spanner nut 80*a*, barrel member 82*a*, and plate member 84*a* can shift relative to one another in the second exemplary embodiment of the invention. The cap member 74*a* and the combined structure are not intended to move significantly relative to one another, however the volume of the thrust cavity can change in order to generate balance forces. The cap member 74*a* can at least substantially seal against the casing 78*a* through a sealing member 86*a*.

A rotor 22*a* can extend through a closed end of the barrel member 82*a* and is also fixed to the casing 78*a*, spanner nut 80*a*, barrel member 82*a*, and plate member 84*a*. In operation, the rotor 22*a* can be subjected to axial thrust loads in response to the compression of fluid in the compressor section 16 (shown in FIG. 1). An arrow 32*a* represents the direction of axial thrust loads on the rotor 22*a*. The axial thrust loads can also be transmitted through the casing 78*a*, spanner nut 80*a*, barrel member 82*a*, and plate member 84*a* since these components are fixed to the rotor 22*a*.

As set forth above, the plate member 84*a* defines the pressure face 40*a*. When pressurized fluid fills the thrust cavity 76*a*, a balance force represented by an arrow 88*a* can be generated on the pressure face 40*a*. The balance force represented by arrow 88*a* at least partially counteracts the axial thrust load represented by arrow 32*a*.

As made clear by the description above, the second exemplary embodiment of the invention provides a fully passive system counteracting axial thrust loads 32*a* on the rotor 22*a* with pressurized fuel from the fuel system 44*a*. In some applications, a fully passive system may be the most efficient way to practice the invention. However, the broader invention is not limited to a fully passive system. Embodiments of the invention can be practiced with one or more active components, including sensors, controllers, actuators, and valves.

The pressurized fuel can also be applied to lubricate a component in the engine. Lubrication of another component of the engine is not required of the broader invention; however, the exemplary embodiments disclosed herein provide several alternative approaches to lubricating a thrust bearing 36*a*. Other components of an engine could be lubricated in other embodiments of the invention and the approaches set forth herein are provided as examples and are not inclusive. Also, embodiments of the invention can be practiced in which fuel is not bled from the thrust cavity to lubricate components.

FIG. 3 shows a thrust bearing 36*a* disposed in a sump cavity 90*a*. The sump cavity 90*a* can be defined by a sump housing 92*a* which, in turn, can be defined by the first frame member 66*a* as well as secondary structures 94*a*, 96*a*, 98*a*. The thrust bearing 36*a* can include an inner race 100*a*, an outer race 102*a*, and roller members 104*a* disposed between the inner race 100*a* and the outer race 102*a*.

FIG. 3 shows that fluid passageway 42*a* can include a first sub-passageway 106*a* extending to the valve 68*a* and a second sub-passageway 108*a* extending away from the first sub-passageway 106*a*. The second sub-passageway 108*a* is isolated from the thrust cavity 76*a* and can deliver fuel to the thrust bearing 36*a*. Although not shown, the second sub-passageway 108*a* can extend around the cap member 74*a* and the casing 78*a* to the inner race 100*a* of the thrust bearing 36*a*.

It is also noted that the seal 86*a* shown in FIG. 3 can be designed to permit some bypass of pressurized fuel from the thrust cavity 76*a* to lubricate the thrust bearing 36*a*.

Figure 4:
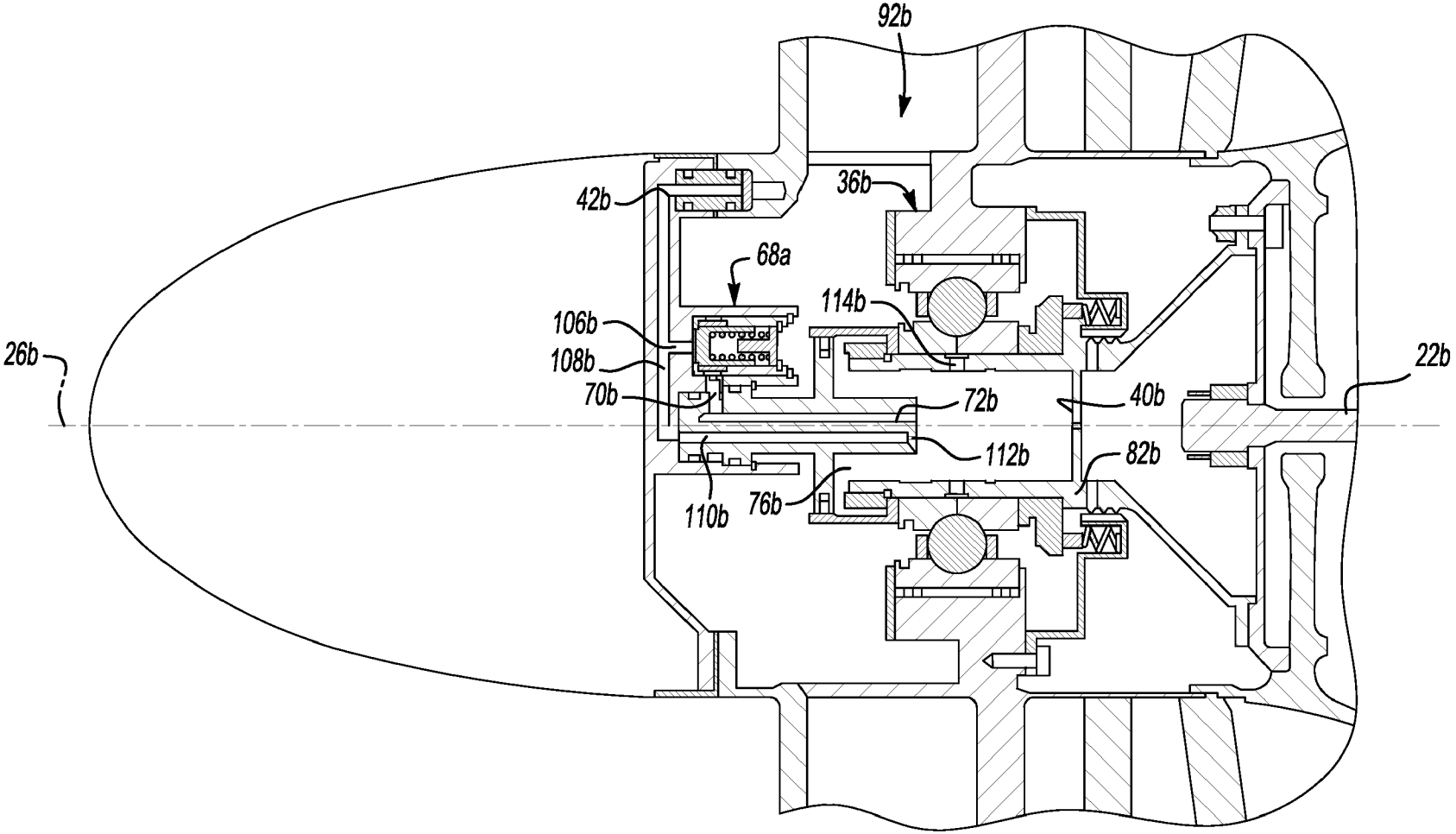
FIG. 4 is a cross-section of a second exemplary embodiment of the invention.
Figure 5:
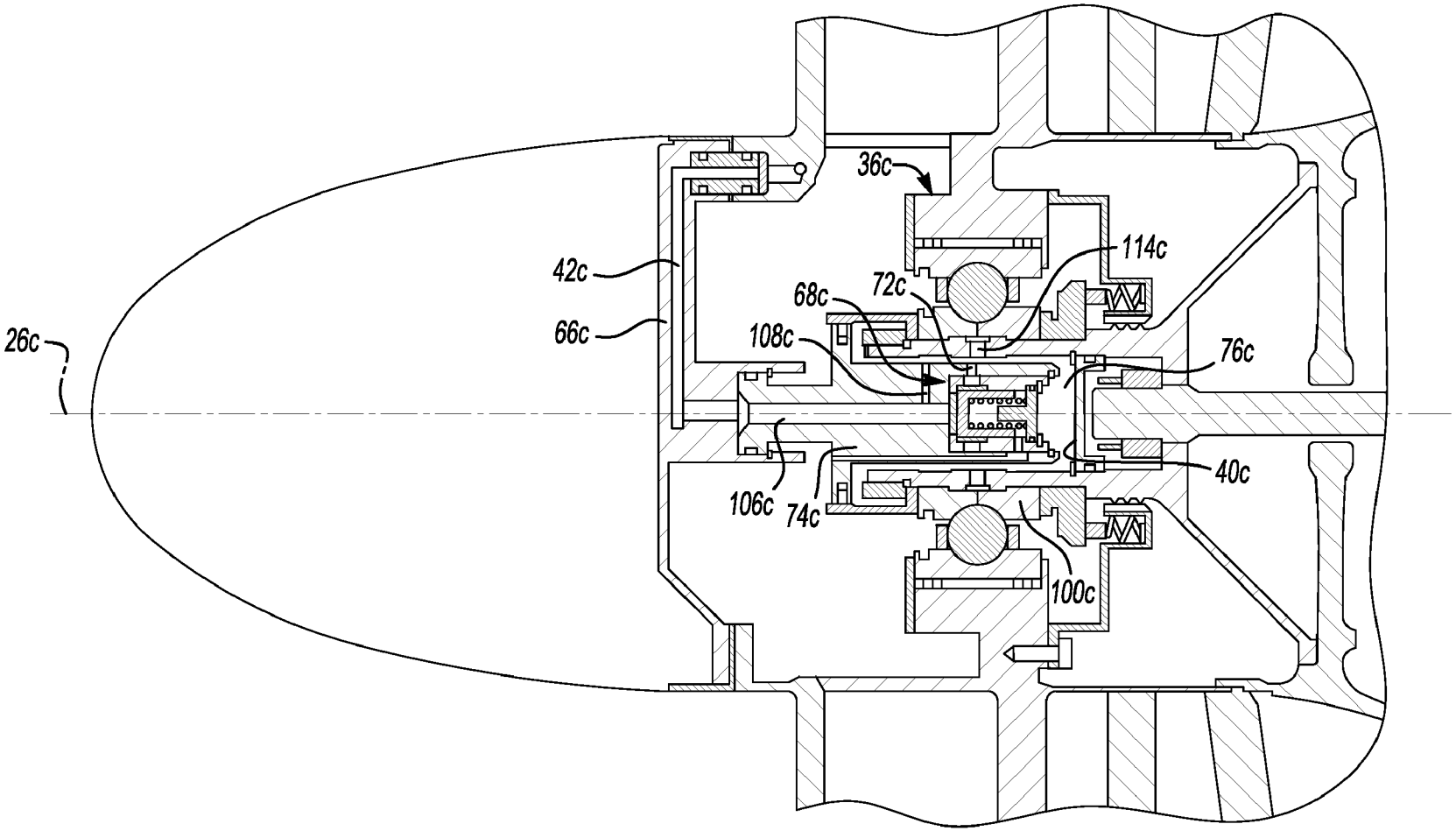
FIG. 5 is a cross-section of a third exemplary embodiment of the invention.

FIGS. 4 and 5 show alternative structures for bleeding fuel from the pressure face in the thrust cavity to lubricate a thrust bearing. In FIG. 4, a second sub-passageway 108*b* of a fluid passageway 42*b* can communicate pressurized fuel to a passageway 110*b* extending through a cap member 74*b*. The passageway 110*b* can terminate in a bleed orifice 112*b*. A bleed path 114*b* can extend through a barrel member 82*b* between a thrust cavity 76*b* and a thrust bearing 36*b*. A first sub-passageway 106*b* of a fluid passageway 42*b* can communicate pressurized fuel to the thrust cavity 76*b* through passageways 70*b* and 72*b*. Thus, in the second exemplary embodiment of the invention, the thrust cavity 76*b* can receive first and second streams of pressurized fuel separate from one another.

The stream of pressurized fuel reaching the thrust cavity 76*b* through the passageway 72*b* can be selectively stopped by a valve 68*b* upstream of the passageway 72*b*. The stream of pressurized fuel reaching the thrust cavity 76*b* through the passageway 110*b* can be continuous. The bleed orifice 112*b* can limit the rate of fuel flow such that thrust bearing 36*b* can continuously receive lubricant, but, on the other hand, the flow of pressurized fuel into the thrust cavity 76*b* from the bleed orifice 112*b* will not result in any undesirable thrust cross-overs wherein the amount of force generated on a pressure face 40*b* would be greater than the axial thrust load on a rotor 22*b*.

FIG. 5 shows a third exemplary embodiment of the invention. A fluid passageway 42*c* can extend from a first frame member 66*c* through a cap member 74*c*. The fluid passageway 42*c* can bifurcate in the cap member 74*c* into first and second sub-passageways 106*c* and 108*c*. The first sub-passageway 106*c* can extend to a valve 68*c* and the second sub-passageway 108*c* can extend away from the first sub-passageway 106*c*. A first stream of fuel at a predetermined level of pressure or greater can pass through the valve 68*c* and a passageway 72*c*, into a thrust cavity 76*c*. The pressurized fuel in the thrust cavity 76*c* can act on a pressure face 40*c* and can pass through a bleed path 114*c* to lubricate an inner race 100*c* of a thrust bearing 36*c*. A second stream of fuel can pass into the thrust cavity 76*c* directly from the second sub-passageway 108*c*. The exemplary second sub-passageway 108*c* does not terminate in a bleed orifice, but can be sized to balance the goals of lubricating the thrust bearing 36*c* while preventing thrust cross-overs.

Embodiments of the invention can be practiced wherein a valve applied to selectively stop the flow of pressurized fuel to the thrust cavity is designed or is intended to bypass some fuel while in the closed configuration. For example, in FIG. 5, the valve 68*c* can be designed to bypass fuel into the thrust cavity 76*c* while in a closed configuration to ensure that fuel is continuously available to pass through the bleed path 114*c* and lubricate the thrust bearing 36*c*. Such a valve can complement the flow of fuel through the second sub-passageway 108*c* or obviate the need for the second sub-passageway 108*c*. Also, such a valve can be applied in other embodiments of the invention to vent fuel to a component of the engine to be lubricated.

For example, in the embodiment of the invention shown in FIG. 5, the valve 68*c* is exposed in the thrust cavity 76*c* and, if intended to bypass, would provide fuel to be bled to the thrust bearing 36*c*. In the embodiments of the invention shown in FIGS. 3 and 4, the respective valves 68*a* and 68*b* are exposed in respective sump housings 92*a* and 92*b* and, if intended to bypass, would vent fuel to lubricate the respective thrust bearings 36*a* and 36*b*.

Figure 6:
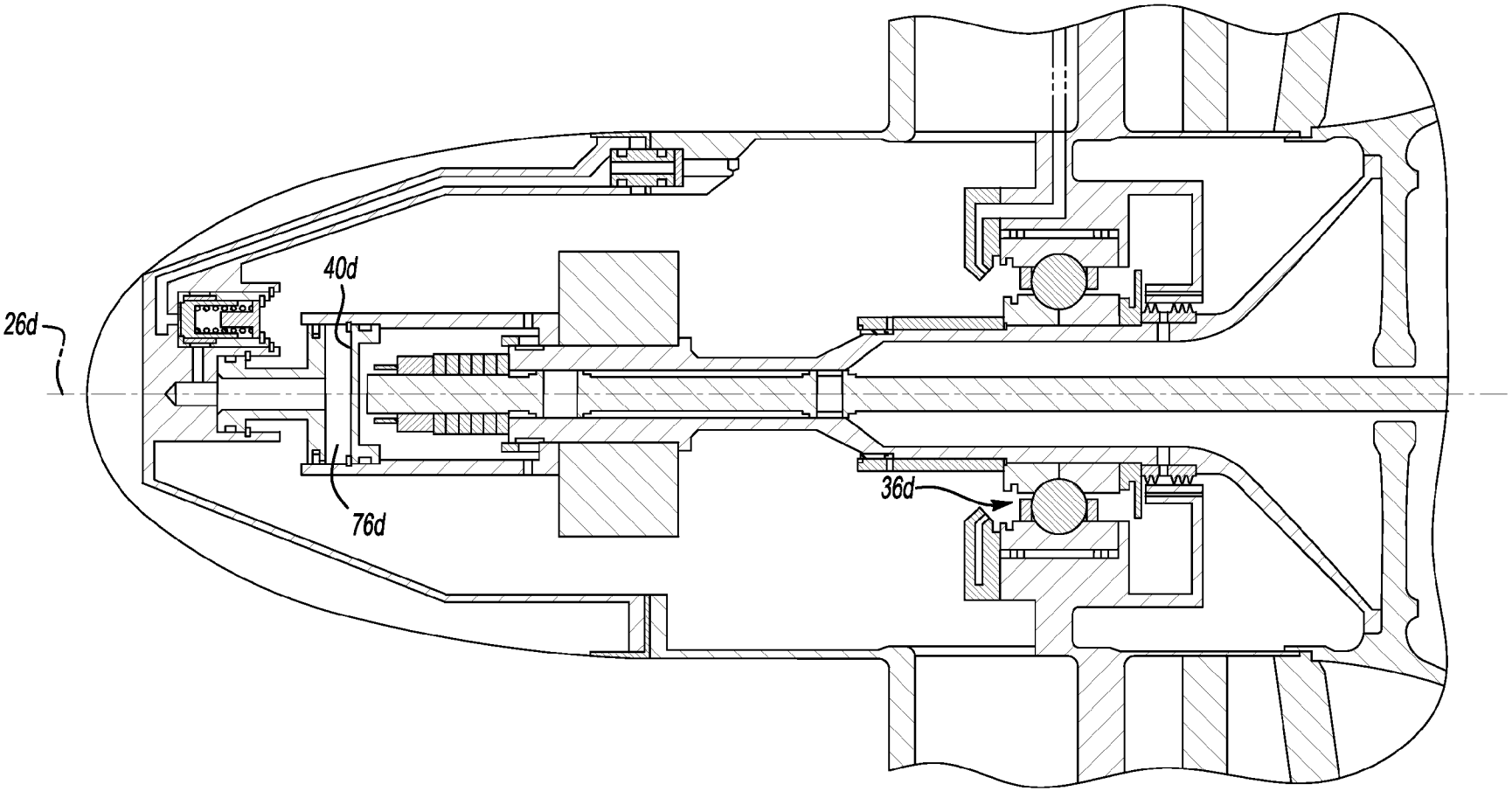
FIG. 6 is a cross-section of a fourth exemplary embodiment of the invention.

FIG. 6 shows a fourth embodiment of the invention. A comparison of the Figures of reveals that another advantage provided by the various embodiments of the invention is that the position of the balance piston relative to other structures is flexible. In FIGS. 3-5, at least one of the respective pressure faces 40*a*, 40*b*, 40*c* or one of the thrust cavities 76*a*, 76*b*, 76*c* is at least partially aligned radially with the respective thrust bearing 36*a*, 36*b*, 36*c* along a respective centerline axis 26*a*, 26*b*, 26*c*. In FIG. 6, neither a pressure face 40*d* nor a thrust cavity 76*d* is aligned with a thrust bearing 36*d* along a centerline axis 26*d*. Thus, the balance piston can be positioned remotely from a component to be lubricated.

It is also noted that any of the exemplary embodiments of the invention set forth above can be advantageous in turbine engines experiencing relatively high temperatures during operation. For example, high temperature applications often prevent the use of standard lubricants. Fuel can be used to lubricate components such as thrust bearings in place of standard lubricants. As set forth above, embodiments of the invention can be practiced wherein fuel can be bled from a thrust piston cavity or can be bled upstream of the thrust piston cavity.

It is further noted that while the exemplary embodiments of the invention are turbine engines, the invention is not limited to turbine engines.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of at least partially balancing axial thrust loads in an engine comprising:

engaging a balance piston having a pressure face with a rotor operable to rotate about a centerline axis of the engine, the rotor subjected to axial thrust loads along said centerline axis of the engine in operation;

directing pressurized fuel to a combustion chamber of the engine; and delivering pressurized fuel to the pressure face to counteract said axial thrust loads on the rotor.

2. The method of claim 1 wherein said delivering is further defined as:

passively counteracting axial thrust loads on the rotor with pressurized fuel from a fuel system.

3. The method of claim 1 further comprising:

supporting the rotor with a thrust bearing; and bleeding at least some of the pressurized fuel away from the pressure face to lubricate the thrust bearing.

4. The method of claim 1 further comprising:

supporting the rotor with a thrust bearing at least partially enclosed in a sump housing; and venting pressurized fuel into the sump housing to lubricate the thrust bearing.

5. The method of claim 1 further comprising:

enclosing the pressure face in a thrust cavity; and directing the pressurized fuel to the thrust cavity in first and second streams separate from one another.

6. The method of claim 1 further comprising supporting the rotor with a thrust bearing;

enclosing the pressure face in a thrust cavity; and spacing the pressure face and the thrust cavity away from the thrust bearing along an axis of rotation of the rotor.

7. The method of claim 1 further comprising:

selectively stopping a flow of the pressurized fluid to the pressure face in response to a predetermined level of fuel pressure.

8. The method of claim 1 wherein said delivering is further defined as:

diverting at least some of the pressurized fuel from passing to the combustion chamber and directing at least some of the pressurized fuel to the pressure face to counteract axial thrust loads on the rotor.

9. The method of claim 1 wherein said rotor supports a plurality of compressor blades in a compressor section of a gas turbine engine or a plurality of turbine blades in a turbine section of a gas turbine engine.

10. An engine comprising:

a combustion chamber;

a fuel system operable to direct pressurized fuel to said combustion chamber;

a rotor operable to rotate about a centerline axis of the engine and subjected to axial thrust loads along said centerline axis of the engine during operation;

a balance piston engaged with said rotor and including a pressure face positioned in a thrust cavity; and a fluid passageway extending between said fuel system and said thrust cavity to deliver pressurized fuel to said pressure face to counteract said axial thrust loads on said rotor.

11. The engine of claim 10 further comprising:

a thrust bearing supporting said rotor against axial thrust loads; and a bleed path extending between said thrust cavity and said thrust bearing.

12. The engine of claim 10 further comprising:

a valve positioned along said fluid passageway and moveable between open and closed configurations.

13. The engine of claim 12 wherein said valve is operable to bypass fuel while in said closed configuration.

14. The engine of claim 12 wherein said valve is biased to said closed configuration and moved to said open configuration passively and directly by a predetermined level of fuel pressure.

15. The engine of claim 12 wherein said fluid passageway diverges into first and second sub-passageways, wherein said valve is disposed along said first sub-passageway and second sub-passageway terminates in a bleed orifice communicating with said thrust cavity.

16. The engine of claim 10 wherein said rotor supports a plurality of compressor blades in a compressor section of a gas turbine engine or a plurality of turbine blades in a turbine section of a gas turbine engine.

17. A turbine engine comprising:

a combustor section defining a combustion chamber;

a fuel system operable to delivery pressurized fuel to said combustion chamber;

a rotor disposed for rotation about a centerline axis of the engine;

a thrust bearing supporting said rotor against axial thrust loads directed along said centerline axis of the engine;

a sump housing at least partially enclosing said thrust bearing;

a balance piston associated with said rotor and including a pressure face positioned in a thrust cavity;

a fluid passageway extending between said fuel system and said thrust cavity to deliver pressurized fuel to said pressure face to counteract axial thrust loads on said rotor; and a valve positioned along said fluid passageway and moveable between open and closed configurations, said valve being biased to said closed configuration and moved to said open configuration passively and directly by a predetermined level of fuel pressure.

18. The engine of claim 17 wherein said valve is exposed in said sump housing and operable to vent fuel to said thrust bearing.

19. The engine of claim 17 wherein said valve is exposed in said thrust cavity.

20. The engine of claim 17 wherein said thrust bearing is at least partially aligned radially with one of said thrust cavity and said thrust piston along said centerline axis.

21. The engine of claim 17 wherein said valve is a shuttle valve with an emergency bypass.

22. The engine of claim 17 wherein said fluid passageway diverges into first and second sub-passageways, said valve is disposed along said first sub-passageway, said second sub-passageway isolated from said thrust cavity and delivering fuel to said thrust bearing.

23. The engine of claim 17 wherein said rotor supports a plurality of compressor blades in a compressor section of a gas turbine engine or a plurality of turbine blades in a turbine section of a gas turbine engine.

* * * * *